US006907813B2

(12) United States Patent
Gablowski

(10) Patent No.: US 6,907,813 B2
(45) Date of Patent: Jun. 21, 2005

(54) SAFETY MECHANISMS FOR AUTOMATIC FIREARMS

(75) Inventor: Jürgen Gablowski, Oberndorf (DE)

(73) Assignee: Heckler & Koch, GmbH, Oberndorf/Neckar (DE)

( * ) Notice: Subject to any disclaimer, the term of this patent is extended or adjusted under 35 U.S.C. 154(b) by 66 days.

(21) Appl. No.: 10/717,396

(22) Filed: Nov. 19, 2003

(65) Prior Publication Data

US 2004/0194615 A1 Oct. 7, 2004

Related U.S. Application Data

(63) Continuation of application No. PCT/EP02/14599, filed on Dec. 19, 2002.

(30) Foreign Application Priority Data

Dec. 20, 2001 (DE) ..... 101 63 003

(51) Int. Cl.[7] ..... F41A 19/00

(52) U.S. Cl. ..... 89/148; 89/150; 89/154; 89/27.12; 42/70.04

(58) Field of Search ..... 89/148, 150, 154, 89/27.12, 11; 42/70.01, 70.04

(56) References Cited

U.S. PATENT DOCUMENTS 4,133,128 A 1/1979 Brush
4,730,538 A * 3/1988 Zamacola ..... 89/154
4,745,843 A 5/1988 Zedrosser et al.
5,355,768 A * 10/1994 Felk ..... 89/147
6,308,449 B1 * 10/2001 Plebani ..... 42/70.08
6,718,680 B2 * 4/2004 Roca et al. ..... 42/70.08

FOREIGN PATENT DOCUMENTS

| | | |
|---|---|---|
| AU | 416 737 B | 9/1971 |
| DE | 638 052 C | 11/1936 |
| DE | OS 1 428 772 | 1/1970 |
| EP | 0 204 691 A2 | 12/1986 |

* cited by examiner

*Primary Examiner*—J. Woodrow Eldred
(74) *Attorney, Agent, or Firm*—Hanley, Flight & Zimmerman, LLC

(57) ABSTRACT

Automatic firearms and safety mechanisms for automatic firearms are disclosed. In an illustrated example, a disclosed firearm includes a breech mounted for movement between a fired position and a cocked position, a breech catch having an inoperative position and a locked position, and a sear arm mounted to the breech catch. The disclosed firearm also includes a safety to permit at least one of the sear arm and the breech catch to move out of a motion path of the breech when the breech moves from the fired position toward the cocked position, but to maintain the sear arm in engagement with the breech when the breech is in the cocked position and the firearm is dropped

20 Claims, 5 Drawing Sheets

SAFETY MECHANISMS FOR AUTOMATIC FIREARMS

RELATED APPLICATION

This patent issues from a continuation which claims priority from International Patent Application Serial No. PCT/EP02/14599 which was filed on Dec. 19, 2002 and is hereby incorporated by reference in its entirety.

FIELD OF THE DISCLOSURE

This disclosure relates generally to firearms, and, more particularly, to safety mechanisms for automatic firearms.

BACKGROUND

When position references such as "above", "in front" or the like are mentioned in this document, the weapon is assumed to be in normal firing position, firing horizontally "forward" (i.e., away from the shooter).

U.S. Pat. No. 4,133,128, DE-OS 1 428 772 and EP 0 204 691 A2 are known prior art.

Automatic weapons, such as machine guns or sub-machine guns, which are only intended for sustained fire have a rather simple trigger mechanism. As used herein, the term "automatic firearm" is intended to encompass all rapid-firing weapons including machine guns and sub-machine guns. A representative example of a prior art trigger mechanism for an automatic firearm is described in the following.

Beneath the motion path of the breech there is a butt, in which a trigger is swivel-mounted. The swivel axis, which proceeds laterally to the longitudinal axis of the firearm, is located over the trigger, so that, upon operation of the trigger, the rear upper part travels a curved path upward. This rear upper part of the trigger acts on the front end of a breech catch. The breech catch is mounted in the weapon casing or in the butt and can be pivoted around an axis which is also lateral to the longitudinal axis of the firearm. The rear end of the breech catch is constructed as a sear arm. When the trigger is pressed forward to its resting position by a trigger spring, then the front end of the breech catch moves downward, and the sear arm moves upward. This upper position of the sear arm is the locking position.

The breech catch is usually cushioned by a separate spring, which forces it into the locking position. If the breech is pulled back to its resting position with the breech catch in its locking position, then the breech moves the sear arm and, thus, the rear end of the breech catch downward as it passes at least partially over the sear arm. When a sear catch, which is constructed on the bottom of the breech, has passed over the sear arm, then the sear arm snaps upward and engages the sear catch to hold the breech in its rearward position. The weapon is now cocked and ready to fire.

When the trigger is operated, then the sear arm sinks until it releases the sear catch and the weapon begins sustained fire. When the trigger is released, then the sear arm and the sear catch move up to hold the breech in its fire readiness position (rear position). As a result, the sustained fire ceases.

Usually only a safety catch is used as a safety mechanism. While the safety catch rules out unintentional operation of the trigger, it does not rule out a giving way of the sear arm due to, for example, forces of gravity, if the loaded, cocked and trigger-secured machine gun falls off a truck.

While one could also lock the breech catch for security, such an approach has the disadvantage that the breech gets jammed over the breech catch when it is pulled back with a locked weapon, because the breech catch cannot give way.

It is proper to put the weapon on safety when an extraordinary situation occurs. An empty magazine or the end of the ammunition belt can be an extraordinary situation for inexperienced shooters if the breech is located in the front position. However, particularly in the case of a jammed loading mechanism, the attention of the shooter may be completely occupied, so that a mistaken operation of operating devices can occur. In the case of a jammed loading mechanism, the breech should, as the first measure, be pulled back so far that the sear arm falls into the sear catch, so that the caught breech does not come loose, run to the front and inadvertently trigger a shot.

At least in training and at the shooting range, it is also desirable that the breech be pulled back when the safety is on and the firearm not be ready to fire until right before the shot is fired. However, up to now this has only been possible with safety catches.

Figure 1:
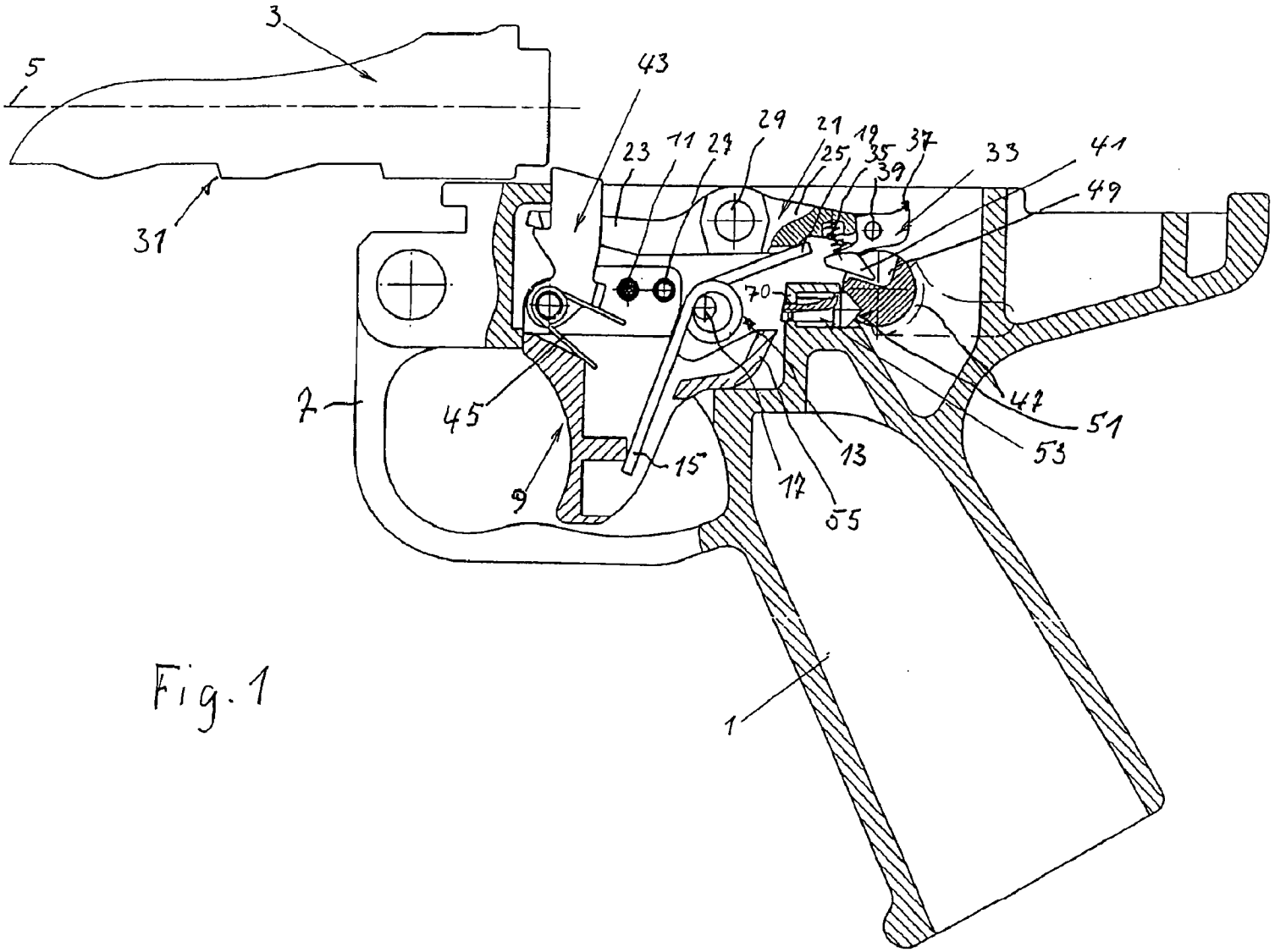
FIG. 1 is a partially cut away sectional view of a butt of an automatic firearm and the rear, bottom part of the breech in the front position.
Figure 2:
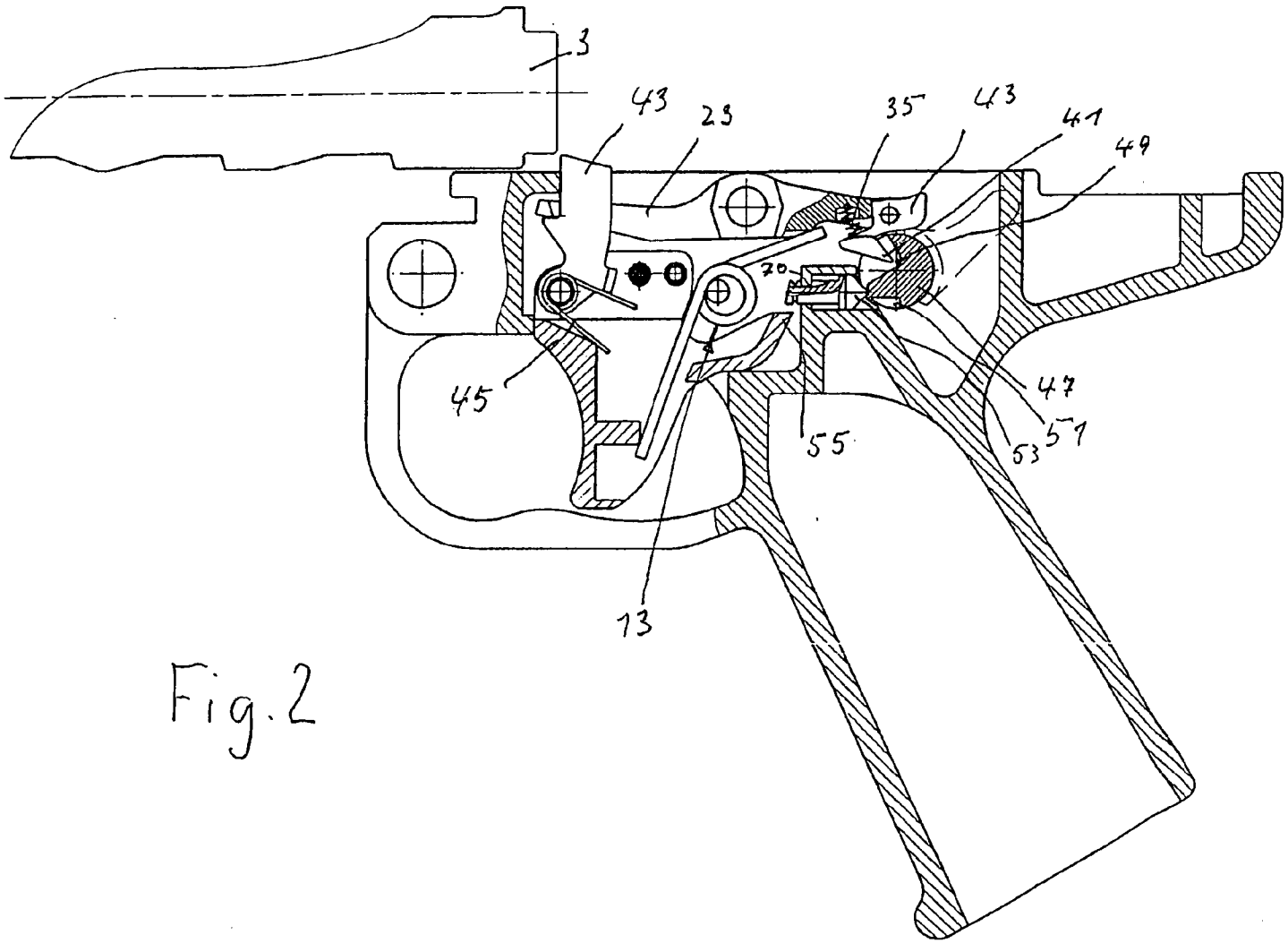
FIGS. 2 through 5 are similar to FIG. 1. However, they illustrate the weapon in a locked state as the breech is moved further to the rear from figure to figure.
Figure 3:
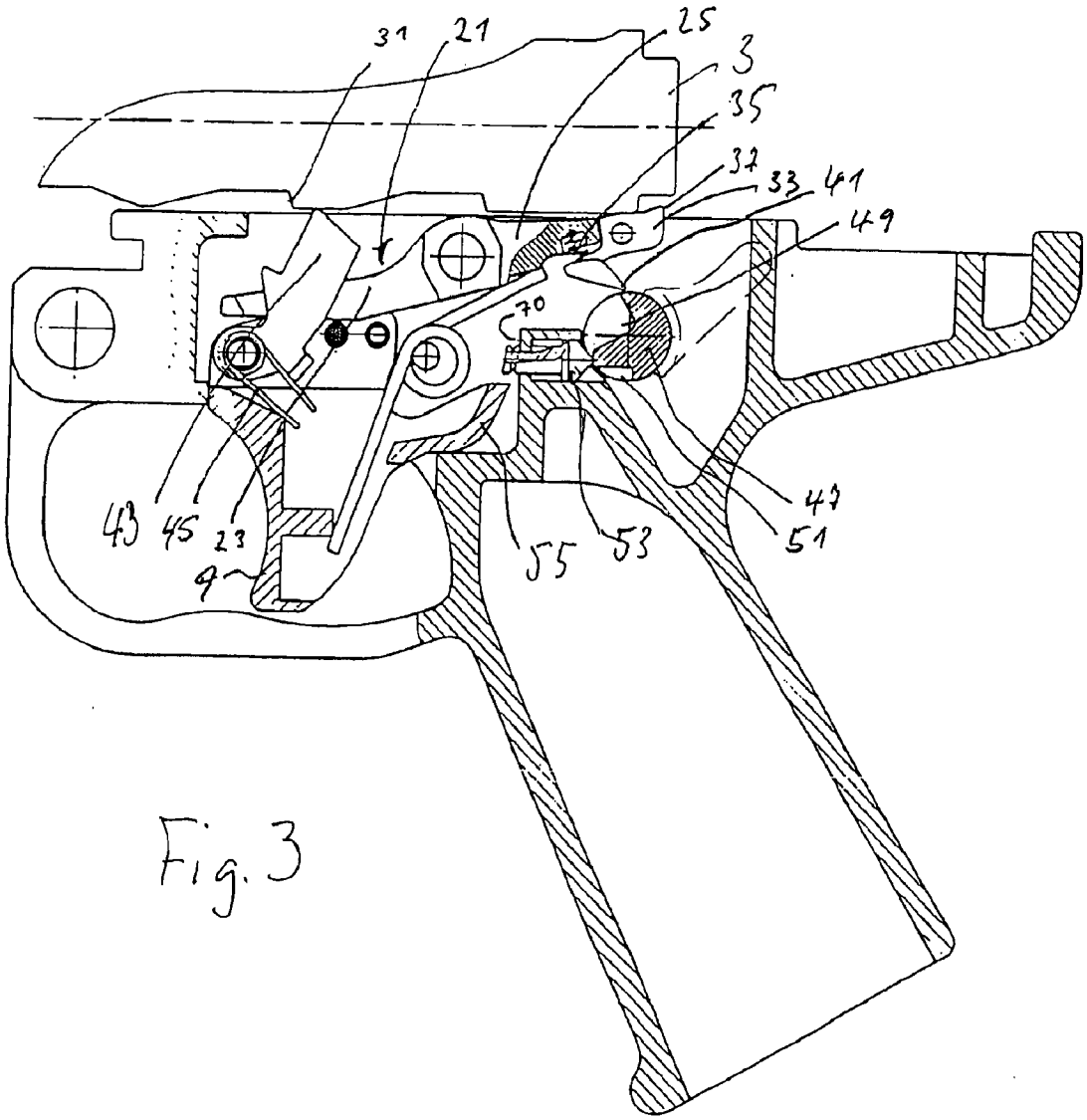
Figure 4:
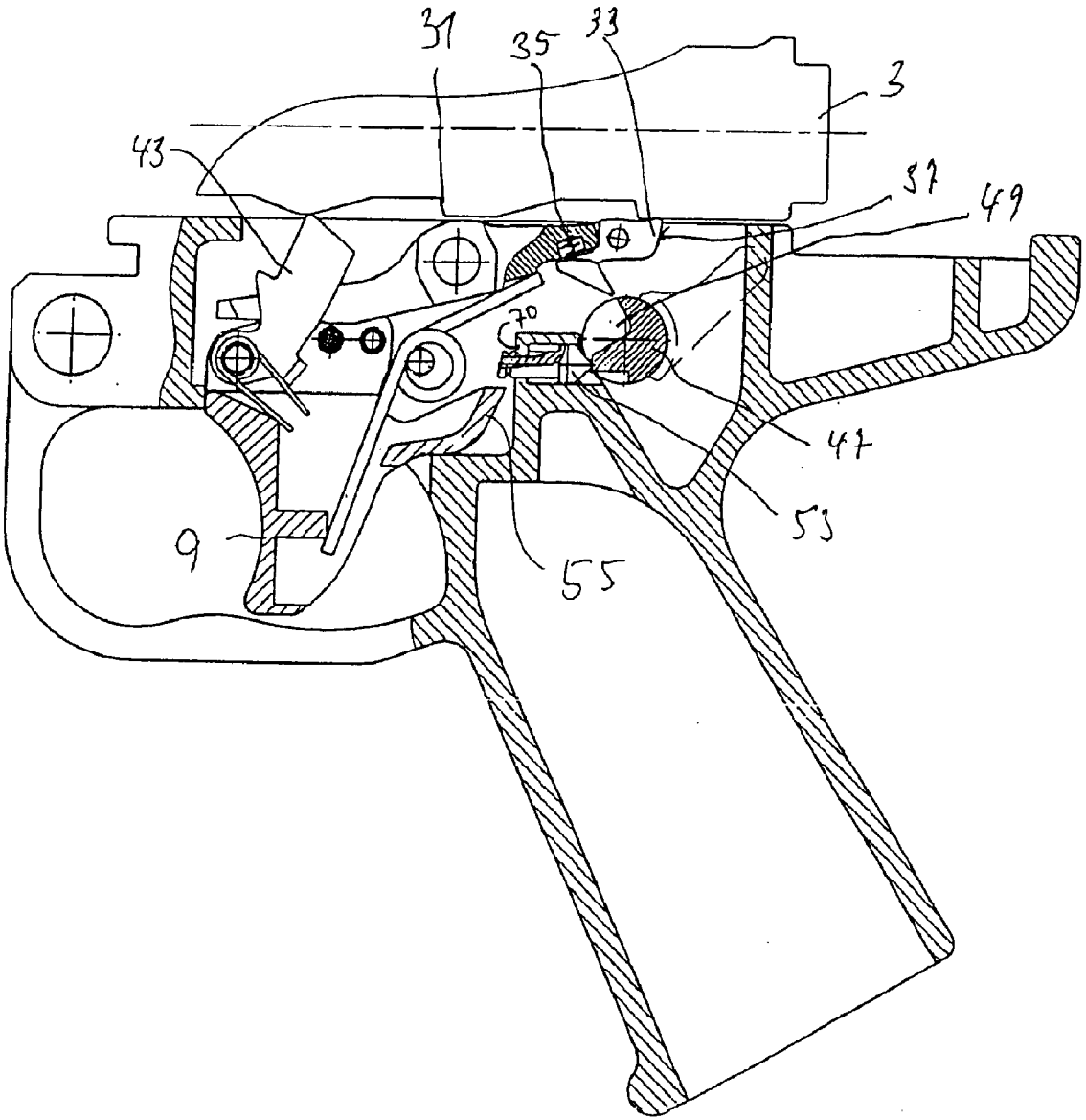

Only in FIG. 1 are all of the drawing reference numerals entered. For reasons of clarity, certain reference numerals have been omitted in FIGS. 2 through 5. However, all of the figures show the same weapon. Therefore, the drawing reference numerals as used in FIG. 1 are valid for all of the figures.

DETAILED DESCRIPTION

A butt 1 of a handheld automatic weapon is shown in the figures. A breech 3 is mounted for movement above the butt 1 such that the breech 3 can be moved horizontally along a center axis 5. The butt 1 is attached to a casing that defines a motion path for the breech 3. For simplicity of illustration, the casing is not shown.

The butt 1 has a trigger guard 7 on the front. A trigger 9 is positioned within the trigger guard 7. The main part of this trigger 9 is an acute triangle with the apex pointed to the bottom. The triangle is penetrated by a lateral running trigger shaft 11 near the middle of its base. A trigger spring 13 in the form of a spiral-shaped wire spring has two legs. The bottom spring leg 15 forces the trigger 9 forward. The central spiral section of the trigger spring 13 loosely surrounds a cross pin 17. The upper spring leg 19 of the trigger spring 13 engages a breech catch 21.

This breech catch 21 is approximately rectilinear in design and has two lever arms, namely, a front lever arm 23 and a rear lever arm 25. The upper spring leg 19 of the trigger spring 13 engages the bottom of the rear lever arm 25. A release roller 27 sits under the center of the front lever arm 23. This release roller 27 can be pivoted around a lateral axis which is seated in the trigger 9, to be precise, near the rear part of the base of the trigger 9. The breech catch 21 is swivel-mounted to a lateral lever axle 29 between the front 23 and the rear lever arm 25.

The upper spring leg 19 loads the breech catch 21 in a counterclockwise direction. The lower spring leg 15 loads the trigger 9 in a clockwise direction. The swivel directions used in this document are referenced to the drawings in which they appear.

If the trigger 9 is operated, that is, pivoted counterclockwise against the force of the trigger spring 13, the release roller 27 lifts the front lever arm 23 against the force of the trigger spring 13 and the end of the rear lever arm 25 is lowered.

A safety catch 33, which pivots around a crossbolt 39, is attached at the rear end of the rear lever arm 25. A sear arm 37 is constructed behind the crossbolt 39 on the upper side of the safety catch 33. A nose 41 which extends forward and downward is constructed in front of the crossbolt 39. A compression spring 35 sits between the bottom side of the rear lever arm 25 and the top side of the nose 41. The compression spring 35 forces the safety catch 33 upward.

Figure 5:
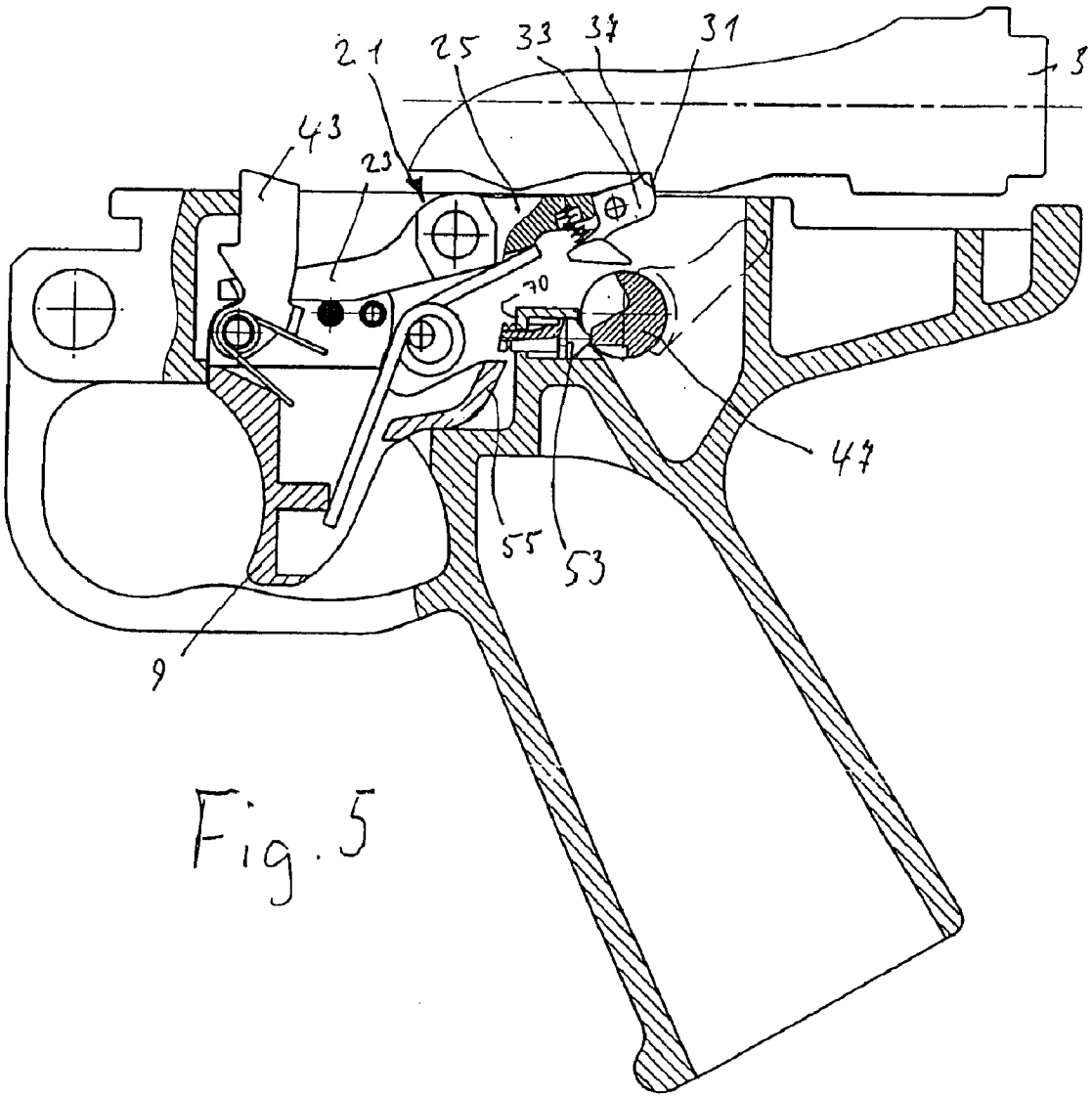

When the breech catch,21 is in the resting position, the sear arm 37 engages in the motion path of the breech 3. If the breech 3 is guided to the rear end of its motion path, then a breech-closing spring (not shown in the figures) attempts to return the breech 3 forward to the position that is shown in FIG. 1. The breech 3 has a sear catch 31 constructed on its bottom side. Therefore, when the breech-closing spring moves the breech 3 forward, the sear catch 31 engages the sear arm 37 and thrusts it forward. As the breech 3 moves forward, it forces the safety catch 33 to an end position against the breech catch 21. The force of the compression spring 35 is supported thereby (FIG. 5).

The front lever arm 23 is bent on its front end and is held in a specified operating position, which is shown in FIG. 1, by a trip-releasing catch 43 positioned underneath. This trip-releasing catch 43 is pivoted around a pin against the force of a catch spring 45. The catch spring 45 biases the trip-releasing catch 43 in a counterclockwise direction. The pin is near the front part of the base of the trigger 9, attached within.

When in the operating position shown in FIG. 1, the free end of the trip-releasing catch 43 extends into the motion path of the breech 3. As a result, the breech catch 21 is kept in the inoperative position when the trigger 9 is released and the breech 3 is not currently in its rear position. Not until the breech 3 moves toward the rear does it engage the trip-releasing catch 43 and turn it in the clockwise direction (compare FIGS. 2 and 3). When the trip-releasing catch 43 turns in the clockwise direction, it releases the breech catch 21. As a result, the breech catch 21 turns counterclockwise, so that the sear arm 37 can engage the sear catch 31 of the breech 3 and hold it in the rear position (FIG. 5). Thus, the trip-releasing catch 43 makes controlled firing of shots possible, as though it were absent.

The trip-releasing catch 43 is, however, also a reason why it is not possible to simply lock the breech catch 21 in the safety-on state by means of a simple so-called "trigger pin safety." For example, FIG. 1 shows the state of the firearm when the shooter has emptied the ammunition belt with the trigger pulled and then releases the trigger. If only the breech catch 21 were locked by means of a trigger pin safety, then, because the trip-releasing catch 43 holds the breech catch 21 in the position of FIG. 1, one could pull back the breech 3 in the safety on state, but the sear arm 37 could not fall into the sear catch 31 of the breech 3. The breech 3 would simply run forward again.

If the trip-releasing catch 43 were not present, then in the position of the breech 3 and the trigger 9 of FIG. 1, the front lever arm 23 would rest on the release roller 27 of the trigger 9. If the breech catch 21 were then locked by means of a trigger pin safety, then the breech 3 could be pulled back, because the safety catch 33 would give way to the force of the compression spring 35 and let the breech pass to the rear. The trigger 9 would still be movable. The shooter, thus, could not determine whether the safety was on or off by lightly activating the trigger (the so-called "taking up the slack of the trigger").

In the following, the manner in which the illustrated trigger device locks both the breech catch 21 and the trigger 9 in the safety-on state is demonstrated.

The butt 1 is penetrated in the rear, upper part by a lateral pivoting safety roller 47. A safety-operation lever sits on an end of this safety roller 47 on the exterior of the butt 1. (Alternatively, two safety levers may be used, one safety lever positioned on each end of the safety roller 47.) The safety-operation lever (which is shown in the figures in dotted lines), is preferably positioned to be easy to reach with the thumb of the hand activating the trigger. Thus, if one lever is used, it should be positioned on the side of the firearm that corresponds to the shooting hand preference of the shooter.

The safety roller 47 has two defined positions, namely, the firing position and the safety position. The firing position is shown in FIG. 1. The safety position is shown in FIGS. 2 through 5.

The safety roller 47 has two recesses at its outer periphery, namely, a safety catch recess 49 and a safety bolt recess 51. Further a horizontal safety bolt 53 is attached in the butt 1 between the trigger 9 and the safety roller 47. The horizontal safety bolt 53 may be moved horizontally to the rear against the force of a safety spring (not shown). The end of the safety bolt 53 facing the safety roller 47 is a stop head constructed in the shape of a truncated cone. When the safety roller 47 is in the firing position, the stop head of the safety bolt 53 falls into the safety bolt recess 51 (FIG. 1) to reliably hold the safety roller 47 in the firing position. When the safety roller 47 is in the safety position (FIGS. 2–5), the apex of the stop head of the safety bolt 53 falls into a small depression in the outer surface of the safety roller 47. This depression cannot be seen in the drawings, but is located between the two recesses 49 and 51.

The safety spring is located in a pocket bore of the butt 1. The bottom of this pocket bore is formed by a wall 70 in the inside of the butt 1. The trigger 9 has a spur-shaped extension 55, which extends from the middle of its rear triangle corner to the rear and above. When the trigger 9 is operated, the free end of this extension 55 moves past the wall 70.

The safety bolt 53 penetrates the pocket bore and pierces through its floor 70 (i.e., the aforementioned wall 70). In the firing position, in which the safety bolt 53 falls into the deep safety bolt recess 51 of the safety roller 47, the front end of the safety bolt 53 terminates about at the surface of the wall 70 facing the trigger 9 (FIG. 1). The trigger 9 can thus be pulled without hindrance.

If the safety roller 47 is moved to the safety position (FIGS. 2–5), then the safety bolt 53 is forced out of the safety bolt recess 51 (i.e. forward; to the left in the figures). The front end of the safety bolt 53 then lies in the swivel path of the extension 55 of the trigger 9. Therefore, the trigger 9 cannot be operated; or at least the trigger cannot be pulled to the full extent of the trigger slack.

If the trigger device is in the position of FIG. 1, then the breech catch 21 is swiveled by means of the trip-releasing catch 43 into an end position, in which the nose 41 of the safety catch 33 runs into the one side wall of the wedge-shaped safety catch recess 49. By turning the safety roller 47 counterclockwise into the safety position, the safety catch recess 49 encompasses the nose 41.

If the breech 3 is now pulled back (FIG. 3), then the trip-releasing catch 43 is turned clockwise and releases the breech catch 21. The rear lever arm 25 then moves in an upward direction and the breech catch 21 snaps counter-clockwise under the effect of the powerful trigger spring 13. In the process, the edge of the nose 41 strikes the other side wall of the safety catch recess 49. The impact of the nose 41 on the side wall of the safety catch recess 49 turns the entire safety catch 33 clockwise against the relatively weak force of the compression spring 35 such that the nose 41 gives way and runs over the edge of the safety catch recess 49 toward the top (see FIG. 4).

When the sear catch 31 is above the sear arm 37, then the sear arm 37 falls into the sear catch 31 and the nose 41 pivots over the safety roller 47 (FIG. 5). If the weapon now, for example, falls off a truck to the ground and forces of gravity attempt to swivel the breech catch 21, then the lower area of the nose 41 will collide with the periphery of the safety roller 47. As a result, swivel movement of the safety catch 33 is prevented and the safety catch 33 is locked.

If the safety roller 47 is swiveled back into the firing position, then the trigger 9 and the safety catch 33 are again simultaneously released.

This is how a trigger device with optimum safety and the highest operating convenience is created.

From the foregoing, persons of ordinary skill in the art will appreciate that a firearm has been provided wherein it is possible to put the safety on without the forces of gravity being able to bring the breech catch 21 out of engagement with the breech 3. However, it should always be possible to pull back the breech 3. In other words, while the breech catch 21 is not movable in response to forces of gravity, it is be able to give way to the pulled back breech 3.

To this end, a rapid-firing portable firearm is provided with a trigger device including a trigger 9 that can be pivoted against the force of a spring 13 from a resting position to a fire position. The trigger 9 acts on a swiveling breech catch 21. The breech catch 21 has a sear arm 37 which may be positioned in the motion path of the breech 3. The firearm is further provided with a safety catch mechanism that preferably locks the trigger 9 in its resting position. The sear arm 37 is located on a safety catch 33. The safety catch 33 is swivel-mounted to the breech catch 21. The safety catch 33 may be moved against the force of a spring 35 from a locking position to an inoperative position. In the inoperative position, the safety catch 33 is not in the motion path of the breech 3. The safety catch 33 can be forced into its locking position by the breech 3. The safety catch mechanism (47–55) is also set up to lock the breech catch 21. A spring-mounted trip-releasing catch 43 is attached to the trigger (9). In its resting position, the trip-releasing catch 43 does not permit the breech catch 21 to move into its operative position until the breech 3 moves backward.

The catch 21 has low mass. As a result, the forces of gravity, which become operative in a fall, are lower than the elastic force of the spring 15 which loads the catch 21. In addition, the breech-closing spring forces the breech 3 into engagement with the catch 21, thereby holding the catch 31 in the locking position.

It is possible for the trigger 9 to act exclusively on the breech catch 21. If the trigger 9 is released only a little while the machine gun is firing, then the breech 3 strikes the edge of the sear arm 37 after its recoil. As a result, the safety catch 33 is forced out of the motion path of the breech 3. The precise firing of a single shot or short burst of fire is not possible, because one always has to take into account the possibility that one or two unintended shots will follow.

This problem can be alleviated by means of appropriate training by teaching the soldiers to release the trigger very quickly. However, this is not an acceptable solution. Instead, the illustrated safety catch mechanism addresses this problem by providing a movable edge 47 in the motion path of the safety catch 33. The safety catch 33 and its spring 35 are constructed such that, upon release of the breech catch 21, the safety catch 33 may move past the edge 47, and, in the operative position of the breech catch 21, the edge 47 locks the breech catch 21 and the safety catch 33.

When the trigger is in the released position shown in FIG. 1, the trip-releasing catch 43 keeps the breech catch 21 in an inoperative position until the breech 3 moves back a distance sufficient to operate the catch 43. When the breech 3 pivots the trip-releasing catch 43, the catch 43 releases the breech catch 21. The breech catch 21 responds by snapping into its operative position. Since the spring of the breech catch 21 is stronger than the spring 35 of the safety catch 33, the safety catch 33 gives way to the breech 3, so that, upon attempting to move forward to fire a shot, the breech 3 can fall into the sear catch 37.

The safety catch 33 is swivel-mounted. This mounting takes place at a lateral axis which penetrates the safety catch 33. This lateral axis is mounted on the breech catch 21. When the sear arm 37 gives way to the breech 3 in a counter-clockwise motion, the other end of the safety catch 33 also gives way in a counter-clockwise motion. In the process, the other end of the safety catch emerges under an edge of the safety roller 47. Since the breech catch 21 continues to swing upward under the influence of the spring 15, the safety catch 33 is lifted and swings back above the edge of the safety roller 47, again when the sear arm 37 falls into the sear catch 31. The breech 3 then forces the safety catch 33 firmly against the breech catch 21, since the direction of the force acting upon the sear arm 37 runs above the swivel axis of the breech catch 21 and above the swivel axis of the safety catch 33 and, thus, both elements are turned in the same direction (i.e., toward the breech 3).

When a force of gravity acts on the breech catch 21 and endeavors to move it against the elastic spring force 15, then the safety catch 33 moves along with it and strikes the safety roller 47 with its bottom side (on the same side of the lateral axis as the sear arm 37). The breech catch 21 is, thus, not directly locked, but rather indirectly locked by the safety roller 47.

A backward motion of the breech 3 is, on the other hand, possible, since in response to such backward motion, the safety catch 33 simply swings down. In the process, the safety roller 47 is arranged such that the swinging down of the safety catch 33 is just barely possible. The arrangement and development of the breech catch 21, the safety catch 33, and the safety roller 47, must therefore occur rather precisely with regard to the butt 1. However, this is easily possible without any hand finishing being necessary, since rather few tolerances add up.

The safety catch mechanism could basically be any conventional type of safety catch, (e.g. a sliding safety catch or a push-button safety catch). However, it is particularly advantageous to implement the safety catch mechanism as a lateral running, rotating safety roller 47 in which a recess 49 is constructed whose side wall, together with the circumference of the safety roller 47, forms the edge which engages the safety catch 33 as mentioned above. Such a safety roller 47 has the advantage of laterally penetrating the butt 1, so that an operating handle or safety lever can be attached on either or both of the roller's ends outside of the butt 1. This right or left safety lever has in each case the same allocation to the trigger 9 and can, thus, be used in the same manner, both for right-handers and left-handers.

Advantageously, the safety roller 47 may include a stop recess 51. A safety bolt 53 is also provided, which, in the firing position of the safety roller 47 falls into the stop recess 51. The safety bolt 53 engages in the motion path of the trigger 9 to lock the trigger 9 when the safety roller 47 is located in the locking position and the safety bolt 53 is not, therefore, engaging in the stop recess. Thus, in the illustrated example, a trigger lock is integrated in the safety catch mechanism. Persons of ordinary skill in the art will appreciate that this integration is not only possible with a safety roller 47, but is also possible with different types of safety catches. In locking an automatic firearm, it is required that the safety catch 33 be locked by a powerful stop if the weapon is exposed to severe vibrations during sustained fire. In other words, it is necessary to prevent the weapon from inadvertently locking during the firing.

In the illustrated example, the powerful stop is implemented as a safety catch 33 which automatically engages when and for as long as the safety roller 47 is moved to the safety position. For this purpose, an extension 55 is provided on the trigger 9 which, when the trigger 9 is operated, enters into the motion path of the safety bolt 53. Since the trigger 9 is usually manufactured as a die cast part or a precision cast part, this extension 55 can be manufactured without any additional costs.

A stop recess 51 is also provided in the safety roller 47. The safety bolt 53 falls into this recess 51 as a stop bolt when the weapon is on safety, as is common practice. One or more firing position recesses are also provided. When the safety bolt 53 secures the safety roller 47 in a firing position, rotational motion of the safety roller 47 is restricted in every direction. These firing position recessess can alternatively be constructed on the exterior of the butt 1 and can interact with the operating levers of the safety roller 47.

Although certain example methods and apparatus have been described herein, the-scope of coverage of this patent is not limited thereto. On the contrary, this patent covers all methods, apparatus and articles of manufacture fairly falling within the scope of the appended claims either literally or under the doctrine of equivalents.

What is claimed is:

1. An automatic firearm comprising:

a breech mounted for movement between a fired position and a cocked position;

a breech catch having an inoperative position and a locked position;

a sear arm mounted to the breech catch; and a safety to permit at least one of the sear arm and the breech catch to move out of a motion path of the breech when the breech moves from the fired position toward the cocked position, but to maintain the sear arm in engagement with the breech when the breech is in the cocked position and the firearm is dropped.

2. A firearm as defined in claim 1 wherein the breech catch is pivotable between the inoperative position and the locked position.

3. A firearm as defined in claim 1 wherein the sear arm is pivotably mounted to the breech catch.

4. A firearm as defined in claim 1 wherein the sear arm is part of a safety catch including a nose.

5. A firearm as defined in claim 4 further comprising a spring mounted between the breech catch and the nose.

6. A firearm as defined in claim 4 wherein the safety comprises a safety roller having a safety position and a firing position.

7. A firearm as defined in claim 6 wherein the safety roller defines a first aperture to removably receive the nose.

8. A firearm as defined in claim 7 wherein the nose enters the first aperture when (1) the safety roller is in the firing position, and (2) when the safety roller is in the safety position and the breech moves from the fired position toward the cocked position.

9. A firearm as defined in claim 7 further comprising:

a trigger movable between a released position and a firing position; and a safety bolt having a first position and a second position, the safety bolt preventing movement of the trigger from the released position to the firing position when the safety bolt is in the second position.

10. A firearm as defined in claim 9 wherein the safety roller defines a second aperture to receive the safety bolt when the safety roller is in the firing position, and the safety bolt enters the first position when the safety bolt is in the firing position.

11. A firearm as defined in claim 9 further comprising a trigger spring engaging the trigger and the breech catch.

12. A firearm as defined in claim 9 further comprising a roller coupled to the trigger to move the breech catch to the inoperative position when the trigger moves to the firing position.

13. A firearm as defined in claim 1 further comprising a trip-releasing catch to hold the breech catch in the inoperative position when the breech is in the fired position and a trigger is released.

14. A firearm as defined in claim 13 wherein the trip-releasing catch is movable by the breech moving from the fired position to the cocked position.

15. For use with a handheld automatic firearm having a breech, an apparatus comprising:

a trigger movable between a resting position and a firing position;

a trigger spring biasing the trigger toward the resting position;

a pivotable breech catch;

a safety catch mounted to the breech catch for movement between a locking position and an inoperative position, wherein, when the safety catch is located in a motion path of the breech, the safety catch is forced into its locking position by the breech moving forward; and a safety catch mechanism to lock the trigger in its resting position and to lock the safety catch in engagement with the breech.

16. An apparatus as defined in claim 14 further comprising a trip-releasing catch having a first position wherein the trip-releasing catch releasably secures the breech catch in an inoperative position until the breech trips the trip-releasing catch.

17. An apparatus as defined in claim 14 wherein the safety catch mechanism includes a movable edge located in a motion path of the safety catch, wherein the safety catch is adapted to move past the movable edge when the breech catch pivots from an inoperative position toward a locked position and the safety catch mechanism in a safety position, and wherein the movable edge prevents the breech catch and the safety catch from releasing the breech to fire a shot when the safety catch mechanism is in the safety position.

18. An apparatus as defined in claim 17 wherein the safety catch mechanism is a safety roller defining a recess, and the movable edge is a wall of the recess.

19. An apparatus as defined in claim 18 wherein the safety roller defines a stop and further comprising a safety bolt to engage the stop recess when the safety roller is in a firing position, wherein the safety bolt is prevents movement of the trigger from the resting position to the firing position when the safety roller is in the safety position.

20. An apparatus as defined in claim 14 wherein the trigger includes an extension to engage the safety bolt to prevent the trigger from moving from the resting position to the firing position when the safety roller is in the safety position.

* * * * *